US005103253A

United States Patent [19]

Uchiyama

[11] Patent Number: 5,103,253

[45] Date of Patent: Apr. 7, 1992

[54] PHOTOGRAPHIC MATERIAL PROCESSING APPARATUS

[75] Inventor: Kaoru Uchiyama, Kanagawa, Japan

[73] Assignee: Fuji Photo Film Co., Ltd., Kanagawa, Japan

[21] Appl. No.: 612,376

[22] Filed: Nov. 14, 1990

[30] Foreign Application Priority Data

Nov. 20, 1989 [JP] Japan ..... 1-299741

[51] Int. Cl.[5] ..... G03D 3/06; G03D 3/08

[52] U.S. Cl. ..... 354/322; 354/324; 354/325; 354/339

[58] Field of Search ..... 354/320, 321, 322, 324, 354/325, 338, 339

[56] References Cited

U.S. PATENT DOCUMENTS 4,839,683 6/1989 Kushima et al. ..... 354/322

4,943,823 7/1990 Uchiyama et al. ..... 354/322

*Primary Examiner*—A. A. Mathews

*Attorney, Agent, or Firm*—Sughrue, Mion, Zinn, Macpeak & Seas

[57] ABSTRACT

In a photographic material processing apparatus in which a photographic material is conveyed while being immersed and processed in photographic material processing liquids, guide members are provided at each boundary between adjacent processing tanks, and a cleansing liquid is supplied to the contact surfaces of guide members contacting where a photographic material comes into contact with the guide members to thereby rinse off the processing liquid adhering to the guide members. Accordingly, no degenerated matter of the processing liquid adheres to the guide members, the photographic material is not stained through contact with the guide members, and processing can be performed uniformly.

9 Claims, 3 Drawing Sheets

PHOTOGRAPHIC MATERIAL PROCESSING APPARATUS

BACKGROUND OF THE INVENTION

The present invention relates to a photographic material processing apparatus for performing developing processing and the like by immersing, in a processing liquid, a photographic material exposed to rays transmitted through or reflected from an original document or picture, or to rays obtained by converting electric signals photoelectrically.

Generally, in an automatic developing apparatus using a silver halide photographic material, development is performed by conveying a photographic material while immersing it in a developing liquid stored in a developing tank for a predetermined time.

Generally, the photographic material after development is subjected to various treatments such as bleach fixing, rinsing, and the like. In order to effectively convey a photographic material while immersing it in processing tanks holding various processing liquids for such treatments, for example, the processing tanks storing the respective processing liquids are disposed in parallel. In order to effectively immerse the photographic material in the respective processing liquids, each processing tank has a longitudinally elongated shape so that the photographic material is conveyed in each processing tank in the vertical direction. More specifically, a photographic material is conveyed vertically downwards in a processing liquid in a processing tank, reversed in direction when it reaches a bottom portion of the processing tank so that it is then conveyed vertically upwards in the same processing liquid, reversed in direction again when it emerges from the processing liquid, and then sent to the next processing tank.

Since the photographic material is conveyed through a plurality of processing tanks, if a large quantity of processing liquid of a preceding stage processing tank adhering to the photographic material is mixed with a processing liquid of the succeeding stage processing tank, the composition of the processing liquid of the latter can be changed to the extent that the desired processing cannot be performed. Therefore, when a photographic material is conveyed from a processing tank in a preceding stage to a processing tank in a succeeding stage, in order to minimize the quantity of the processing liquid of the preceding stage processing tank brought into the succeeding stage processing tank, for example, squeeze rollers are provided between the preceding and succeeding stage processing tanks so that the photographic material is conveyed from the preceding stage processing tank into the succeeding stage processing tank while eliminating the processing liquid adhering to the photographic material conveyed from the preceding stage processing tank. In addition, guide members are provided for safely guiding a photographic material from a preceding stage processing tank into a succeeding stage tank.

When a copying machine employing such a system is used in an office or the like, in many cases the power supply for the copying machine is turned off after the completion of the day's work and the operation of the copying machine is stopped until the next day. If the copying machine is not used for a long time, processing liquid adhering to guide members provided between processing tanks can be oxidized through contact with the atmosphere or condensed due to evaporation of its moisture content, so that the quality thereof deteriorates.

When such a copying machine is started after being out of use for a long time, degenerated matter from the processing liquid adhering to the guide members can be transferred to the photographic material guided by the guide members. This can cause staining of the photographic material is stained or prevent it from being processed uniformly.

SUMMARY OF THE INVENTION

It is therefore an object of the present invention to solve the foregoing problems in the prior art.

It is another object of the present invention to provide a photographic material processing apparatus in which no degenerated matter from processing liquid adheres to guide members provided between processing tanks so that superior processing can be achieved and staining of the photographic material avoided.

In order to attain the foregoing objects, according to the present invention, a photographic material processing apparatus in which a photographic material is conveyed while being immersed and processed in photographic material processing liquids is provided which comprises: guide members provided between adjacent processing tanks containing the processing liquids for guiding the photographic material; and means for supplying a cleansing liquid to portions of the guide members where the photographic material comes into contact with the guide members.

That is, cleansing liquid is supplied to the contact surface of the guide members where the photographic material comes into contact with the guide members so that processing liquid adhering to the guide member is rinsed away, whereby no degenerated matter from the processing liquid adheres to the guide members so that the photographic material is not stained through contact with the guide members and processing can be performed uniformly.

Although the cleansing liquid supplied to the guide members may be withdrawn after cleansing the guide members, it is preferred that the cleansing liquid be supplied further to a photographic material conveying means provided in the vicinity of the guide members to thereby cleanse the contact surface of the photographic material where the photographic material comes into contact with the conveying means. By supplying the cleansing liquid also to the photographic material conveying means and rinsing away the processing liquid adhering to the conveying means, no degenerated matter from the processing liquid component adheres to the conveying means, and the photographic material conveyed by the conveying means is not stained.

It is effective to provide a layer of material having less repellency, such as phenol resin, on the surfaces of the guide members to thereby facilitate the flow of the cleansing liquid, or to roughen the surfaces of the guide members so as not to be an obstacle to guiding the photographic material and not damage the surface of a photographic material. It is also effective to make the guide members of a material immersed in a surface active agent or the like.

If the cleansing liquid does not have any component which may deteriorate the function of a processing liquid, the cleansing liquid after cleansing the guide members or the photographic material conveying means may be allowed to fall into a lower processing tank so as to supplement the evaporated component of the processing liquid in the lower processing tank.

The processing operations of photographic material with which the present invention may be employed include developing, bleaching, fixing, bleach fixing, stabilizing, rinsing, etc., but the invention may be used with any type of processing so long as the processing is of the type in which a photographic material is processed while being immersed in a processing liquid.

The photographic material to be used in the present invention may be either a negative photographic material or a direct positive photographic material.

Photographic techniques for obtaining a direct positive image without requiring reversal processing or a negative film are of course well known.

Methods of forming a positive image by use of a conventionally known direct positive silver halide photographic material (except for certain special methods) can be mainly classified into the following two types if practical utility is taken into consideration:

The first type is such that silver halide emulsion fogged in advance is used, and a direct positive image is obtained after development by breaking a fog nucleus (latent image) by use of solarization or the Herschel effect or the like.

In the second type an internal latent image type silver halide emulsion which is not fogged in advance is used, and a direct positive image after development is obtained by performing surface development after or while performing a fogging processing after exposure of an image.

The above-mentioned internal latent image type silver halide photographic emulsion is defined as a type of silver halide photographic emulsion which has a photosensitive nucleus of silver halide particle mainly internally and in which a latent image is formed mainly inside the particles through exposure.

Various techniques have been known for producing a photographic material of a direct positive type having a comparatively high sensitivity. Examples of the most important of such techniques are disclosed in U.S. Pat. Nos. 2,592,250, 2,466,957, 2,497,875, 2,588,982, 3,317,322, 3,761,266, 3,761,276, and 3,796,577, and U.K. Patents Nos. 1,151,363, 1,150,553, and 1,011,062.

Such photographic materials can be applied in various applications, for example, as a color reversal film for slide or television, a color reversal paper, and an instant color film. In addition, the present invention can be applied to a full color copying machine or a color hard copying machine for preserving an image on a CRT. Also, the present invention can be applied to a black and white photographic material using a three color coupler mixture, as described in "Research Disclosure", No. 17123, July, 1978.

The present invention can also be applied to other black and white photographic materials.

Examples of those black and white (B/W) photographic materials to which the present invention can be applied include such B/W direct positive photographic materials as an X-ray photographic material, a duplicate photographic material, a microphotographic material, a photocomposition photographic material, and a print photographic material, as disclosed, for instance, in Japanese Unexamined Patent Publications Nos. Sho-59-208540 and Sho-60-260039.

BRIEF DESCRIPTION OF THE DRAWINGS

Other features and advantages of the present invention will be apparent from the following description taken in connection with the accompanying drawings, wherein.

DESCRIPTION OF THE PREFERRED EMBODIMENTS

Preferred embodiments of the present invention will now be described with reference to the drawings.

Figure 1:
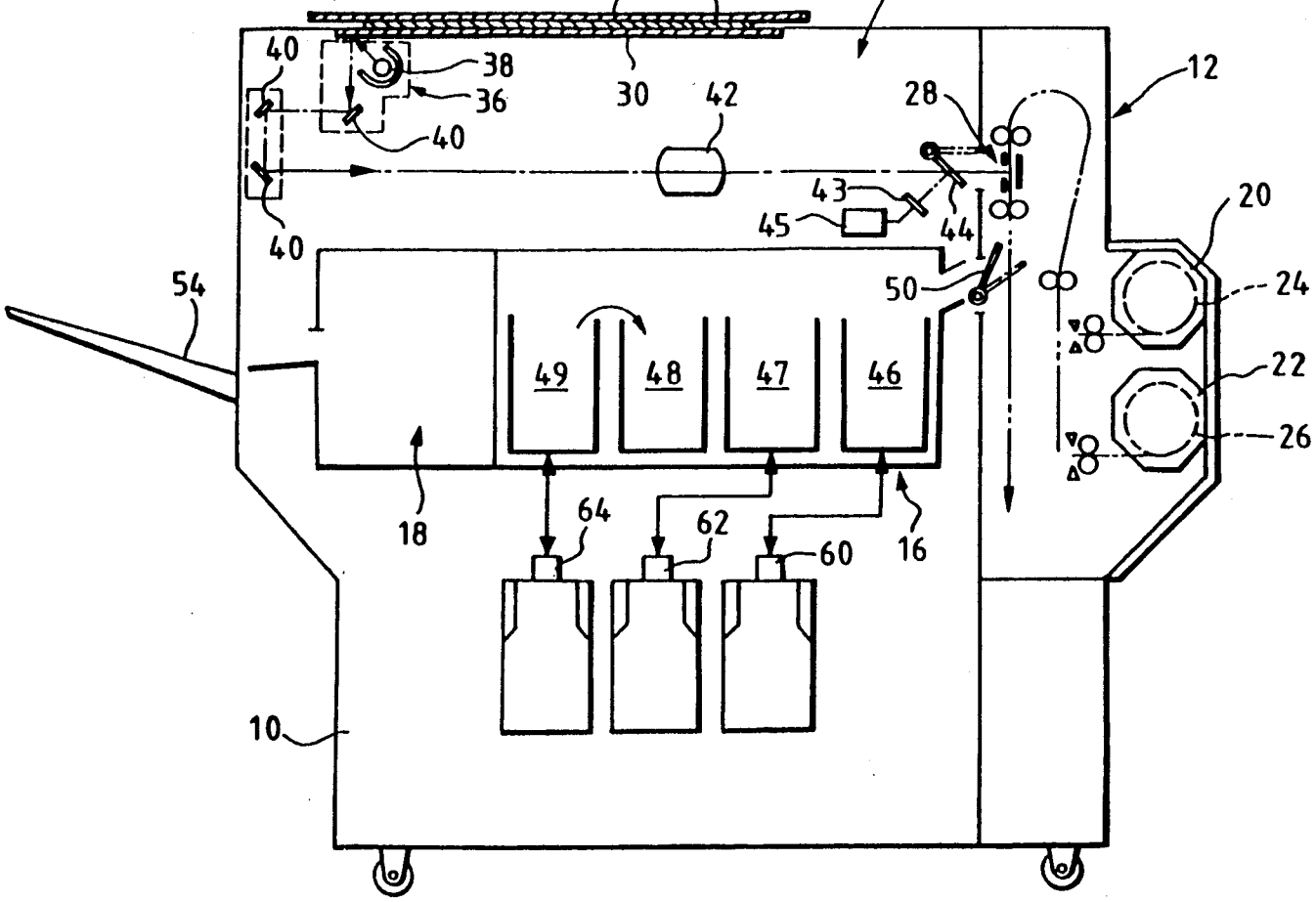
FIG. 1 is a longitudinal sectional view illustrating a silver salt photographic color copying machine to which the present invention is applied.

FIG. 1 is a schematic configuration diagram illustrating a silver salt photographic color copying machine employing a preferred embodiment of the present invention.

A paper feeding section 12 is provided in the right side of an apparatus body 10, an exposing section 14 and a processing section 16 are provided in the upper side thereof, and a drying section 18 is provided in the left side thereof. This silver salt photographic color copying machine is arranged so that a pair of magazines 20 and 22 can be mounted in the upper and lower portions thereof. In the respective magazines 20 and 22, photographic materials 24 and 26 are stored in the rolled state so that the forward end portions of the materials can be pulled out of the respective magazines 20 and 22 and fed into the paper feeding section 12. For example, the photographic material 24 may be an optimum material for copying a color photographic original document, while the photographic material 26 is optimum for copying a color print original document. Since the configurations for processing the two types of photographic materials 24 and 26 are the same, the configuration of the copying machine will be described along the processing for the photographic material 24.

The photographic material 24 pulled out from the magazine is fed through the paper feeding section 12 to an exposing window 28 in which an image of a color original document 32 on a transparent original document platen 30 provided above the exposing section 14 is exposed with light. This color original document 32 is pressed against the original document platen 30 by an original document presser 34, and irradiated by a light source 38 in a light source unit 36 so that the photographic material 24 located in the exposing window 28 is exposed, using optics 42 and a shutter 44, which is in an opened state, with light carrying an image of the color original document 32 reflected from a plurality of mirrors 40.

In the closed state of the shutter 44, the light carrying an original document image is reflected on the shutter 44 and incident into an image sensor 43 so that exposure correction conditions are determined by a control means 45.

In the processing section 16, a developing tank 46, a bleach-fixing tank 47, and rinsing tanks 48 and 49 are provided in sequence, and the photographic material 24 upon which developing, bleaching, fixing and rinsing have been performed by processing liquids charged in the respective tanks is fed to the drying section 18. The respective processing liquids are supplemented suitably from supplementary tanks 60, 62 and 64.

In the drying section 18, the rinsed photographic material 24 is dried and fed out onto a take-out tray 54.

Figure 2:
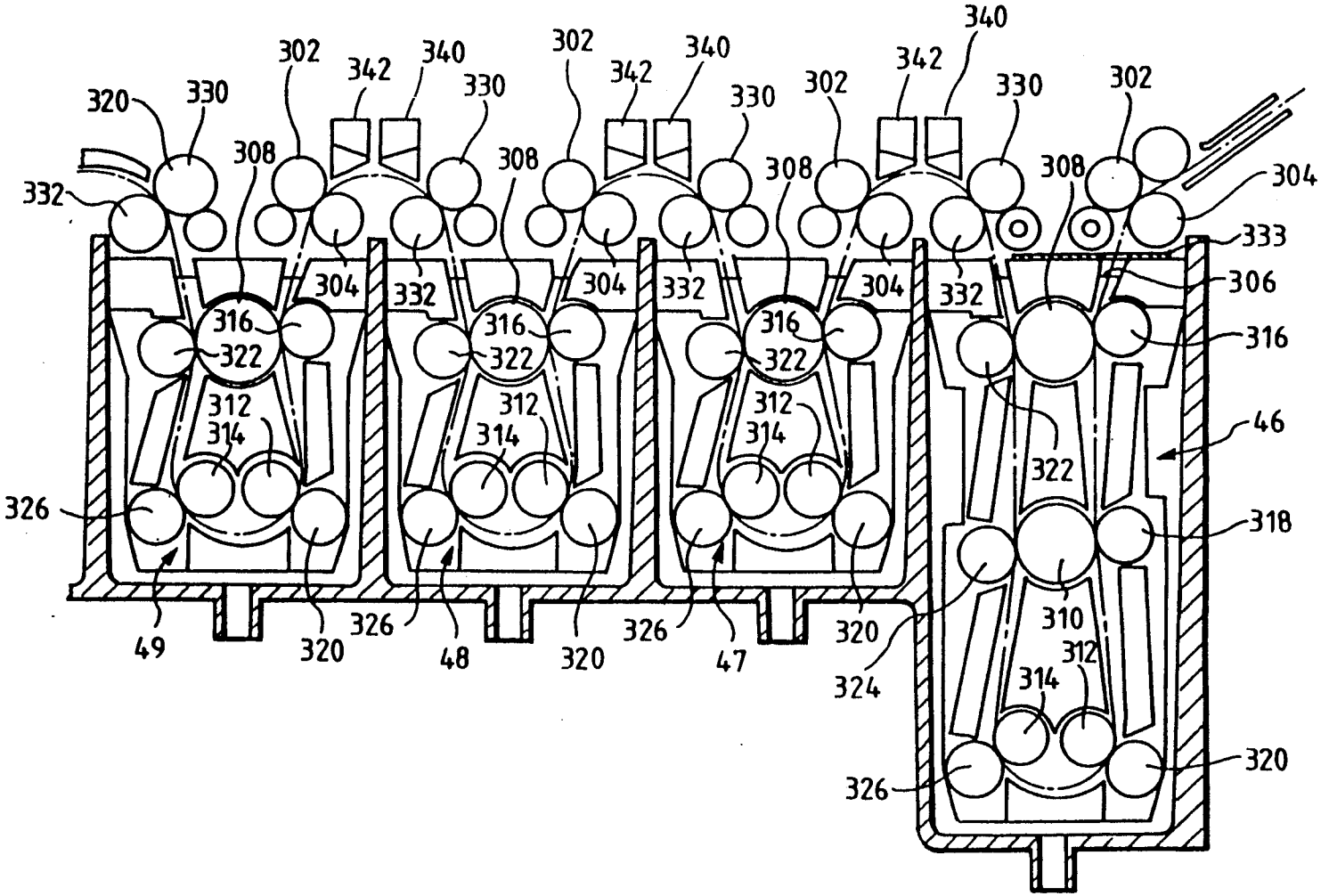
FIG. 2 is a schematic configuration diagram illustrating a processing section.

FIG. 2 is a schematic configuration diagram illustrating the processing section 16.

The processing section 16 is constituted by the developing tank 46 for performing developing processing upon the photographic material 24, the bleach-fixing tank 47 for performing bleaching processing and image fixing processing upon the photographic material 24, and the rinsing tanks 48 and 49 for rinsing the photographic material 24 after the image fixing processing.

There are provided in an entrance portion of the developing tank 46 a pair of holding-conveying rollers 302 and 304, which feed the exposed photographic material 24 into developing liquid 306 in the developing tank 46.

In addition, in the developing tank 46, a conveying roller 308, a conveying roller 310, and conveying rollers 312 and 314 are horizontally pivoted. The conveying roller 308 and the conveying roller 310 are provided in the vicinity of the liquid surface of the developing liquid 306, and in the vertically middle portion in the developing liquid 306. The conveying rollers 312 and 314 are provided at the bottom portion of the developing liquid 306. The conveying rollers 308, 310 and 312 are pressed by conveying rollers 316, 318 and 320, respectively, so that the photographic material 24 fed into between the holding-conveying rollers 302 and 304 is advanced so as to be immersed in the developing liquid 306.

The conveying rollers 308, 310 and 314 are pressed by conveying rollers 322, 324 and 326 so that the photographic material 24 is pulled out of the developing liquid 306 and fed between holding-conveying rollers 330 and 332 located in an exit portion of the tank 46. The holding-conveying rollers 330 and 332 act to feed the photographic material 24 extracted from the developing tank 46 into the bleach-fixing tank 47.

A shutter 333 is provided in the vicinity of the liquid surface of the developing liquid in the developing tank 46 so as to cover the liquid surface of the developing liquid except during the time the photographic material 24 passes through the tank to thereby prevent evaporation of the developing liquid.

The bleach-fixing tank 47 and the rinsing tanks 48 and 49 have the same configuration as that of the developing tank 46, but the conveying rollers 310, 318 and 324 provided in the vertically intermediate portion in the developing tank 46 are omitted so that those tanks are lower in height.

The conveying rollers are rotated in the conveying direction of the photographic material 24 by the driving force of a motor or the like (not shown).

At each of the boundaries between the developing tank 46 and the bleach-fixing tank 47, between the bleach-fixing tank 47 and the rinsing tank 48, and between the rinsing tank 48 and 49, there are provided a pair of guide members 340 and 342 for guiding the photographic material 24 between the exit portion holding-conveying rollers 330 and 332 and the entrance portion holding-conveying rollers 302 and 304. The guide members 340 and 342 will be described in detail with reference to FIGS. 3 and 4.

Figure 3:
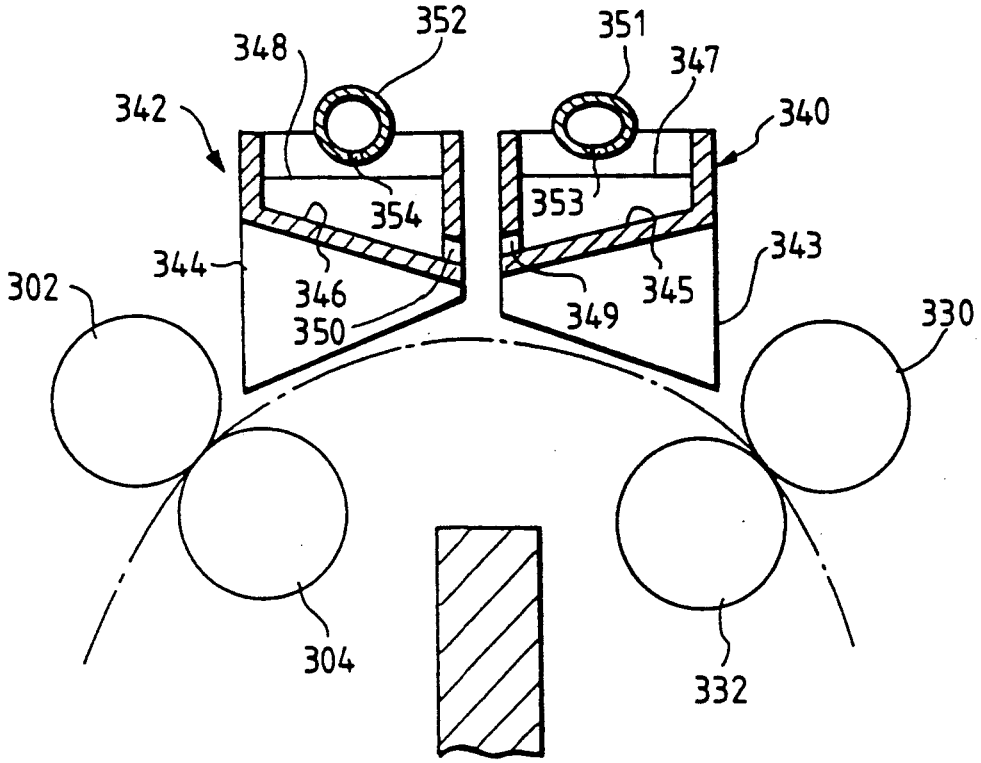
FIG. 3 is a schematic arrangement diagram illustrating the neighborhood of guide members.
Figure 4:
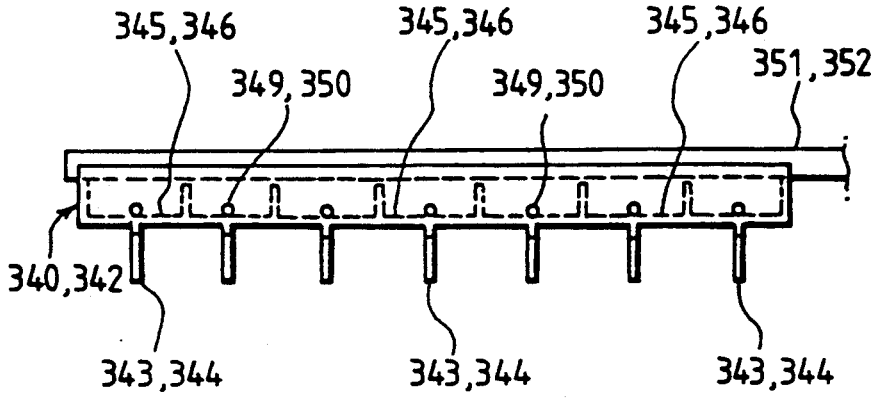
FIG. 4 is a front view illustrating the guide members.

FIG. 3 is a schematic configuration diagram illustrating the vicinity of the guide members 340 and 342, and FIG. 4 is a front view illustrating the guide members 340 and 342.

The guide members 340 and 342, which are provided in pairs, have thin-plate like ribs 343 and 344 separated by a predetermined distance from each other in the width direction of the photographic material 24. The top end portions of the ribs 343 and 344 are inclined toward the conveying rollers 330 and 332, and toward the conveying rollers 302 and 304. The lowest end portions of the ribs 343 and 344 are located above the conveying rollers 332 and 304, respectively. In the upper portions of the ribs 343 and 344, cleansing liquid storing sections 345 and 346 are provided which are divided by partitions 347 and 348 corresponding to the respective ribs 343 and 344. On the uppermost portions of the inclined portions of the ribs 343 and 344 opposite the photographic material 24 in the cleansing liquid storing sections 345 and 346 are formed holes 349 and 350 for allowing the cleansing liquid to flow therethrough. In the upper portions of the respective cleansing liquid storing sections 345 and 346, pipes 351 and 352 are provided in the width direction of the photographic material 24, and the cleansing liquid is supplied to the respective cleansing liquid storing sections 345 and 346 through the holes 353 and 354 formed in the lower portions of the pipes 351 and 352, respectively. The cleansing liquid supplied to the cleansing liquid storing sections 345 and 346 flows out through the holes 349 and 350, passes along the ribs 343 and 344, and falls onto the holding-conveying rollers 332 and 304. Since the respective cleansing liquid storing sections 345 and 346 are divided by the partitions 347 and 348, the cleansing liquid flows out through the respective holes 349 and 350 uniformly.

The photographic material 24 conveyed out from the processing liquid in the preceding stage by the exit portion holding-conveying rollers 330 and 332 are guided by the distal end portions of the ribs 343 and 344 of the pair of guide members 340 and 342 and conveyed into the processing liquid in the succeeding stage. Then, the photographic material 24, guided by the rib 343 of the upstream guide member 340, reaches the rib 344 of the downstream guide member 342 so that the photographic material 24 does not jam between the guide members 340 and 342. Then the exit portion holding-conveying rollers 330 and 332, acting as squeeze rollers, eliminate most parts of the processing liquid adhering to the photographic material 24.

If the photographic material processing frequency is high, it is not always necessary to cleanse the guide members 340 and 342, and therefore cleansing the guide members 340 and 342 is performed only when the copying machine is not used for a certain period, such as when the day's work is finished. For instance, if a work stop switch of the copying machine is operated, such as when the day's work is finished, the copying machine stops operating after cleansing the guide members 340 and 342.

For example, if a work stop switch of the copying machine is operated, the predetermined quantity of cleansing liquid is supplied to the cleansing liquid storing sections 345 and 346 through the pipes 351 and 352. The cleansing liquid supplied to the cleansing liquid storing sections 345 and 346 flows through the holes 349 and 350, passes along the ribs 343 and 344, and falls onto the holding-conveying rollers 332 and 304. Then the processing liquid adhering to the ribs 343 and 344 flows down onto the holding-conveying rollers 332 and 304 together with the cleansing liquid. In addition, the holding-conveying rollers 332 and 304 onto which the processing liquid flows are rotated for a relatively long time period so as to cleanse the circumferential surfaces of the holding-conveying rollers 330, 332, 302 and 304. It is preferred that the cleansing liquid flowing down from the ribs 343 and 344 fall in the vicinity of the respective contact portions of the holding-conveying rollers 330, 332, 302 and 304. It is also effective that the cleansing liquid flowing down from the ribs 343 and 344 fall onto the circumferential surfaces of the holding-conveying rollers 330 and 302 located in the upper area.

Although the surfaces of the guide members 340 and 342 and the holding-conveying rollers 330, 332, 302 and 304 after cleansing are dried while the copying machine is stopped, since no degenerated matter of the processing liquid adheres to the contact portions of the guide members 340 and 342 and the holding-conveying rollers 330, 332, 302 and 304 where the photographic material 24 comes into contact with those rollers, the photographic material 24 is not stained with degenerated matter when processing is performed again. Thus, it is possible to obtain superior image quality.

In this embodiment, water to be supplemented to the rinsing tanks 48 and 49 is used as a cleansing liquid, the water after cleansing the guide members 340 and 342 and the holding-conveying rollers 330, 332, 302 and 304 is allowed to fall as it is into the lower processing tank so as to be supplemented into the processing liquid. Therefore, the quantity of the cleansing water supplied to the guide members 340 and 342 is determined taking account of the supplemental quantity. For example, the same quantity of water as that lost by evaporation of the processing liquid is supplied to the guide members 340 and 342, so that it is possible to supplement the evaporated and reduced component of the processing liquid as well as cleanse the guide members 340 and 342 and the holding-conveying rollers 330, 332, 302 and 304 Alternatively, a receiver dish or the like for withdrawing the cleansing liquid after cleansing may be provided in the lower portion of the entrance portion holding-conveying rollers 302 and 304 to prevent the processing liquid in the preceding stage adhering to the guide member 342 and the entrance portion holding-conveying rollers 302 and 304 from being mixed into the processing liquid in the succeeding stage together with the cleansing liquid.

Although this embodiment has a configuration such that the cleansing liquid is supplied to the cleansing liquid storing sections 345 and 346 provided in the upper portions of the ribs 343 and 344 and flows towards the ribs 343 and 344, the structure for supplying the cleansing liquid to the guide members 340 and 342 is not limited in this embodiment. For example, a cleansing liquid supplying device may be arranged so as to spray a cleansing liquid towards the ribs 343 and 344.

According to the present invention, guide members are provided at each boundary between adjacent processing tanks, and a cleansing liquid is supplied to the contact surfaces of guide members contacting the areas where a photographic material comes into contact with the guide members to thereby rinse off the processing liquid adhering to the guide members. Accordingly, no degenerated matter of the processing liquid adheres to the guide members, the photographic material is not stained through contacting with the guide members thereafter, and processing can be performed uniformly.

What is claimed is:

1. A photographic material processing apparatus in which a photographic material is conveyed while being immersed and processed in photographic material processing liquids, said apparatus comprising:

a plurality of processing tanks containing said processing liquids;

guide members provided between adjacent ones of said processing tanks for guiding said photographic material through said tanks; and cleansing means for supplying a cleansing liquid to portions of said guide members where said photographic material comes into contact with said guide members, wherein said cleansing means includes means for storing cleansing liquid therein, and said guide members extend downward from said storing means, said storing means having holes at positions corresponding to said guide members so as to allow said cleansing liquid to flow therethrough so as to supply said cleansing liquid to said guide members.

2. The apparatus according to claim 1, wherein said guide members comprise ribs extending downward from said storing means.

3. The apparatus according to claim 1, wherein said cleansing means further includes means for supplying said cleansing liquid to said storing means.

4. The apparatus according to claim 1, wherein said storing means further comprises a plurality of partitions for dividing said storing means into a plurality of separate chambers.

5. A photographic material processing apparatus which subjects a photographic material to a plurality of processes, said apparatus comprising:

a plurality of vessels, each of said vessels storing therein a respective processing liquid corresponding to each of said processes and having conveying means for conveying said photographic material so that said photographic material is fed in, immersed in, and extracted from said liquid;

means for guiding said photographic material extracted from said liquid stored in a preceding one of said vessels to a succeeding one of said vessels; and means for cleansing said guiding means, wherein said cleansing means comprises a plurality of storing sections each storing cleansing liquid and having a hole to allow said cleansing liquid to flow therethrough, and a pipe located above said storing sections for supplying said cleansing liquid to said storing sections.

6. The apparatus according to claim 5, wherein said guiding means comprises a plurality of ribs, each extending downward from a respective one of said storing sections.

7. A photographic material processing apparatus in which a photographic material is conveyed while being immersed and processed in photographic material processing liquids, said apparatus comprising:

a plurality of processing tanks containing said processing liquids;

guiding means provided between adjacent ones of said processing tanks for guiding said photographic material through said tanks; and cleansing means for supplying a cleansing liquid to portions of said guiding means where said photographic material comes into contact with said guiding means, wherein said cleansing means includes means for storing cleansing liquid therein, and said guiding means includes ribs extending downward from said storing means, said storing means having holes at positions corresponding to said ribs so as to allow said cleansing liquid to flow therethrough so as to supply said cleansing liquid to said ribs.

8. The apparatus according to claim 7, wherein said cleansing means further includes means for supplying said cleansing liquid to said storing means.

9. The apparatus according to claim 7, wherein said storing means further comprises a plurality of partitions for dividing said storing means into a plurality of separate chambers.

* * * * *